United States Patent [19]

Kramer

[11] Patent Number: 4,936,130

[45] Date of Patent: Jun. 26, 1990

[54] APPARATUS FOR ALTERING THE CROSS-SECTIONAL SHAPE OF CAN BODIES

[75] Inventor: Felix Kramer, Friedlisberg, Switzerland

[73] Assignee: Elpatronic AG, Zug, Switzerland

[21] Appl. No.: 303,838

[22] Filed: Jan. 30, 1989

[30] Foreign Application Priority Data

Mar. 15, 1988 [CH] Switzerland ..... 00973/88

[51] Int. Cl.[5] ..... B21D 39/20

[52] U.S. Cl. ..... 72/191; 72/393

[58] Field of Search ..... 72/94, 191, 392, 393; 413/69, 76

[56] References Cited

U.S. PATENT DOCUMENTS

| | | | |
|---|---|---|---|
| 983,278 | 2/1911 | Hartlove | 72/191 |
| 996,122 | 6/1911 | Osborn | 72/94 |
| 2,161,963 | 6/1939 | Khatunzeff | 72/393 |
| 2,872,887 | 2/1959 | Praturlon | 72/191 |
| 3,350,914 | 11/1967 | Ohlsson | 72/393 |

*Primary Examiner*—Lowell A. Larson

*Attorney, Agent, or Firm*—McCormick, Paulding & Huber

[57] ABSTRACT

On a turret (30) which can be driven in rotation about a central axis (A), a plurality of expanding mandrels (42) are arranged all around the central axis (A). They are each essentially composed of a supporting member (44) which is secured to the turret (30) and defines an expanding-mandrel axis (B), a plurality of segmental bars (52) which are arranged all round the expanding-mandrel axis (B) and are guided on the supporting member (44) for radial adjustment, and a wedge (70) which is displaceable along the expanding-mandrel axis (B) to spread the segmental bars (52) apart. The wedges (70) are displaceable in succession, by a common actuating member, during one revolution of the turret (30). The actuating member is a central cam member (18) on which each of the wedges (70) is supported at least during a portion of each revolution of the turret (30) corresponding to the distance between two adjacent expanding mandrels (52).

7 Claims, 6 Drawing Sheets

APPARATUS FOR ALTERING THE CROSS-SECTIONAL SHAPE OF CAN BODIES

Figure 1:
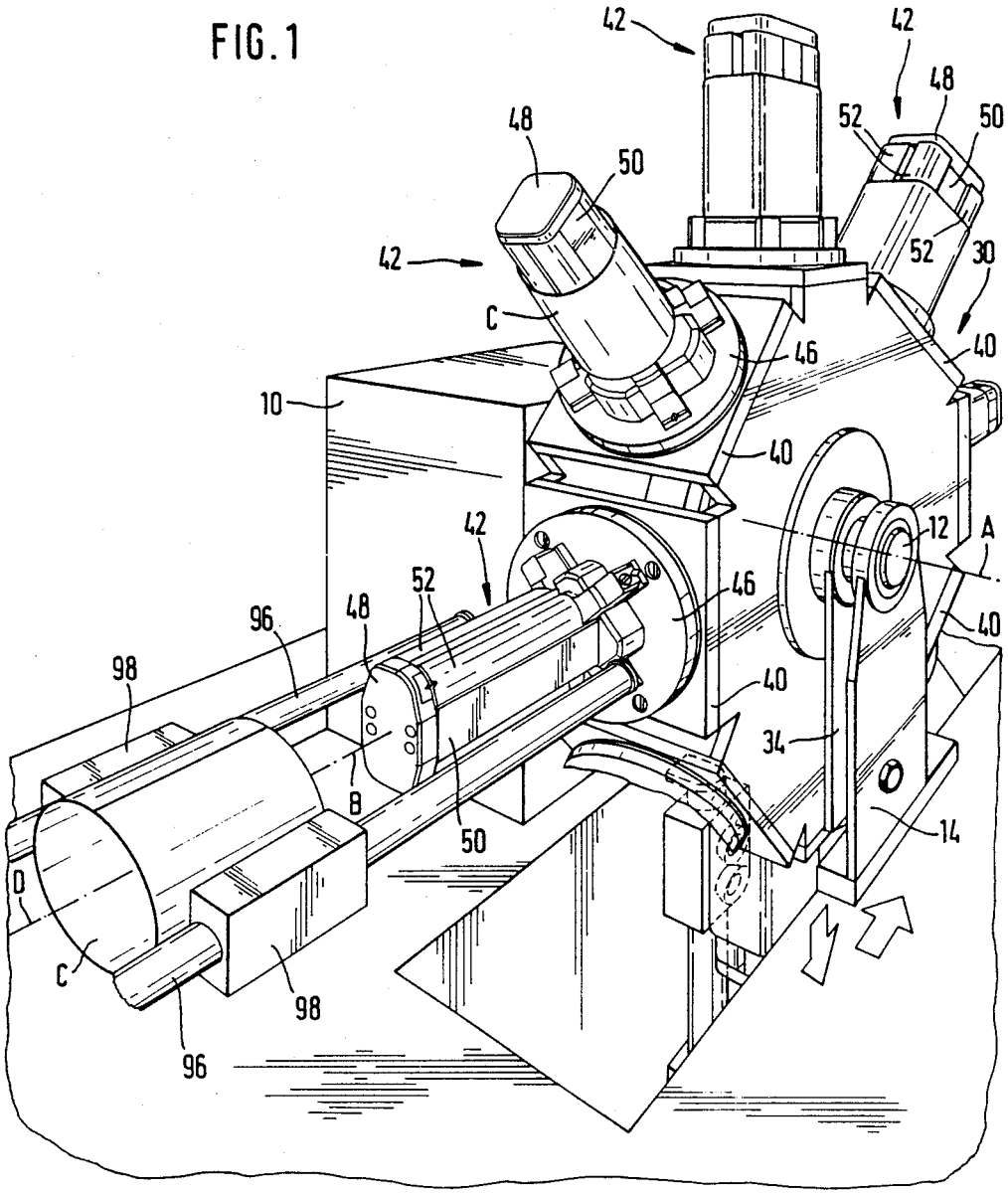

The invention relates to an apparatus for altering the cross-sectional shape of can bodies having a turret which can be driven in rotation about a central axis, a plurality of expanding mandrels which are arranged on the turret all round the central axis and are each substantially composed of a supporting member which is secured to the turret and defines an expanding-mandrel axis, a plurality of segmental bars which are arranged all round the expanding-mandrel axis and are guided on the supporting member for radial adjustment, as well as a wedge which is displaceable along the expanding-mandrel axis to spread the segmental bars apart, and, a common actuating member whereby the wedges can be displaced in succession during a revolution of the turret.

Such an apparatus is the subject of the earlier German Patent Application No. P 3725186.4-14. As described there, the need occurs to alter the cross-sectional shape of can blanks, for example when frusto-pyramidal can bodies are to be produced from cylindrical can bodies with a circular cross-section. It may also be necessary, however, to produce can bodies having the same oval or polygonal cross-section over their whole length from bodies which are originally circular cylindrical, that is to say to avoid any taper or frusto-pyramidal shape of the can bodies.

In the apparatus illustrated and described in the earlier Patent Application, the axes of all the expanding mandrels extend parallel to the central axis of the turret. A piston-and-cylinder unit is provided as a common actuating member with which all the expanding mandrels are brought into alignment in succession during a revolution of the turret and which is extended more or less abruptly each time in order to actuate the expanding mandrel in alignment with it. This method of actuation has proved basically satisfactory; nevertheless, it leads to noisy running of the machine when a large number of can bodies have to be deformed per unit of time and accordingly the actuating time for each expanding mandrel has to be kept short.

It is therefore the object of the invention to construct an apparatus for altering the cross-sectional shape of can bodies in such a manner that it can deform a relatively large number of can bodies per unit of time while running quietly.

According to the invention, the problem is solved with an apparatus of the kind described at the beginning wherein the actuating member is a central cam member against which each of the wedges is supported during a portion of each revolution of the turret corresponding to the spacing between two adjacent expanding mandrels.

Thus the effect is achieved that the shaping of the can bodies takes place during the rotation of the turret. Stoppage times are only necessary, if at all, for pushing the unshaped can bodies onto the expanding mandrels and for removing the shaped can bodies from the expanding mandrels. These charging and removal operations can be carried out in very short periods of time so that a comparatively large proportion of the time which the turret needs for each revolution is available for the deformation of the can bodies.

In accordance with the apparatus illustrated and described in the said earlier patent application, the apparatus according to the invention may have a central shaft which connects the turret to a drive. Starting from this, the invention may be developed further in that the cam member is mounted on the shaft and can be fixed, by an adjusting device, in a selective angular position. As a result, the user of the apparatus according to the invention has the possibility of determining, with a given formation of the cam member, when, during the course of each revolution of the turret, the cam member acts on the individual expanding members.

In a preferred form of embodiment of the invention, the expanding mandrels are arranged in the form of a star and the cam member has a radial curve through the action of which, the wedges can be displaced radially away from the central axis. As an alternative to this, the apparatus illustrated and described in the said earlier patent application may be developed further according to the invention in that expanding mandrels arranged parallel to the central axis can be actuated by means of a central axial cam.

Regardless of which of the two arrangements described above is selected, it is appropriate for each wedge to be supported, via a shank guided in the associated supporting member, against a roller which can roll on the can member.

It is further an advantage if each wedge is preloaded, by at least one spring, counter to the direction in which it can be displaced by action of the cam member in order to spread the associated segmental bars apart. The rollers are preferably held continuously resting against the cam member by the springs.

A quiet running of the apparatus according to the invention can also be promoted in that each of the segmental bars is guided for its movements transverse to the associated expanding-mandrel axis between a foot portion and a head portion of the associated supporting member, by means of rolling-body guides. These rolling-body guides take up the components of force which inevitably occur during the spreading apart of the segmental bars and which act in the direction of expanding-mandrel axis, and they make the segmental bars run easily.

A quiet running of the apparatus can be further promoted in that each of the segmental bars is supported on the associated wedge via a rolling-body guide.

It is true that the two rolling-body guides described may be advantageous independently of the feature of the invention according to which the wedges are actuated by a central cam member. Nevertheless, the smooth actuation of the wedges by the cam member, which may extend over a large part of each revolution of the turret, is particularly facilitated by the rolling bearings according to the invention.

One example of embodiment of the invention is explained below, with further details, with reference to diagrammatic drawings.

Figure 2:
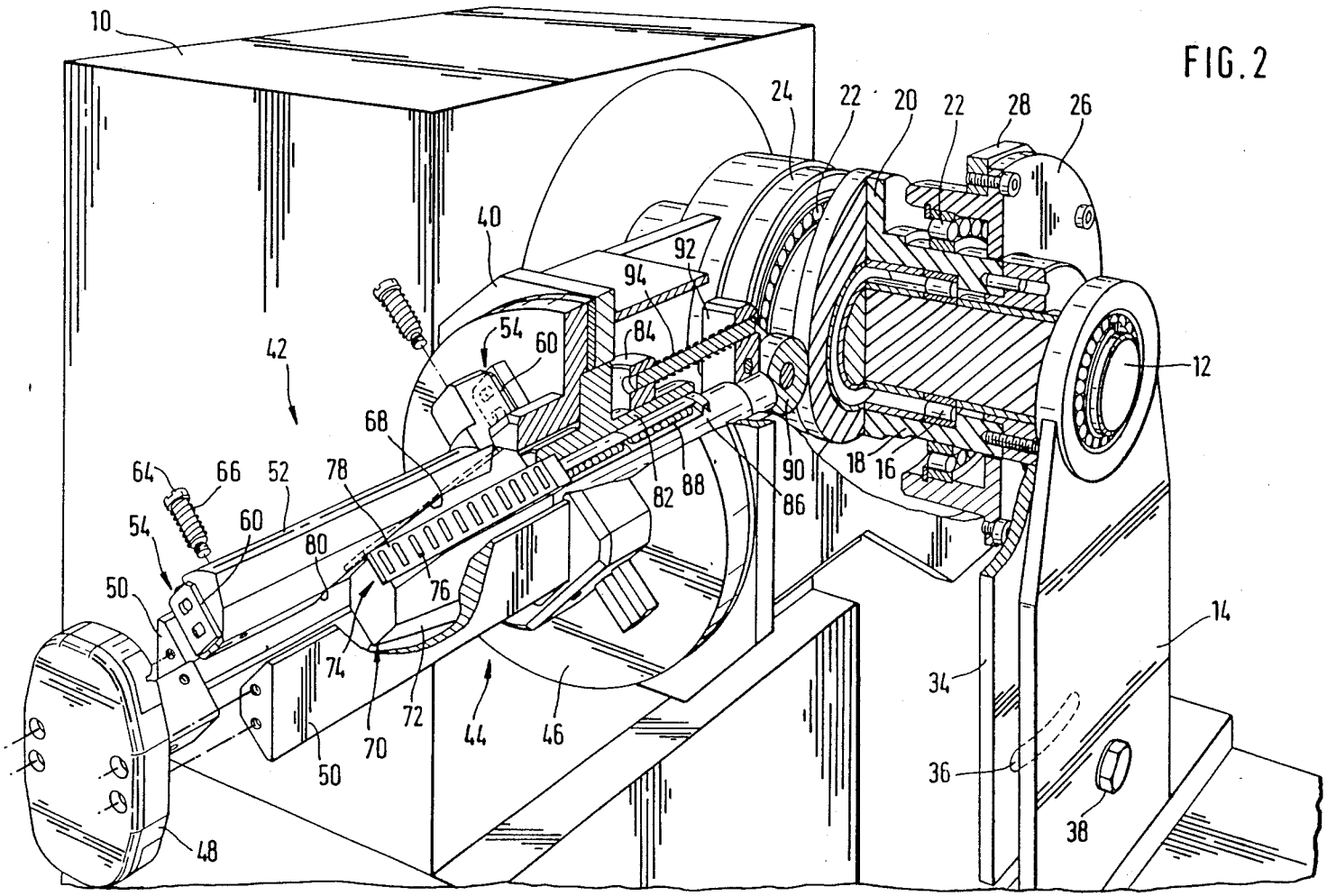
Figure 3:
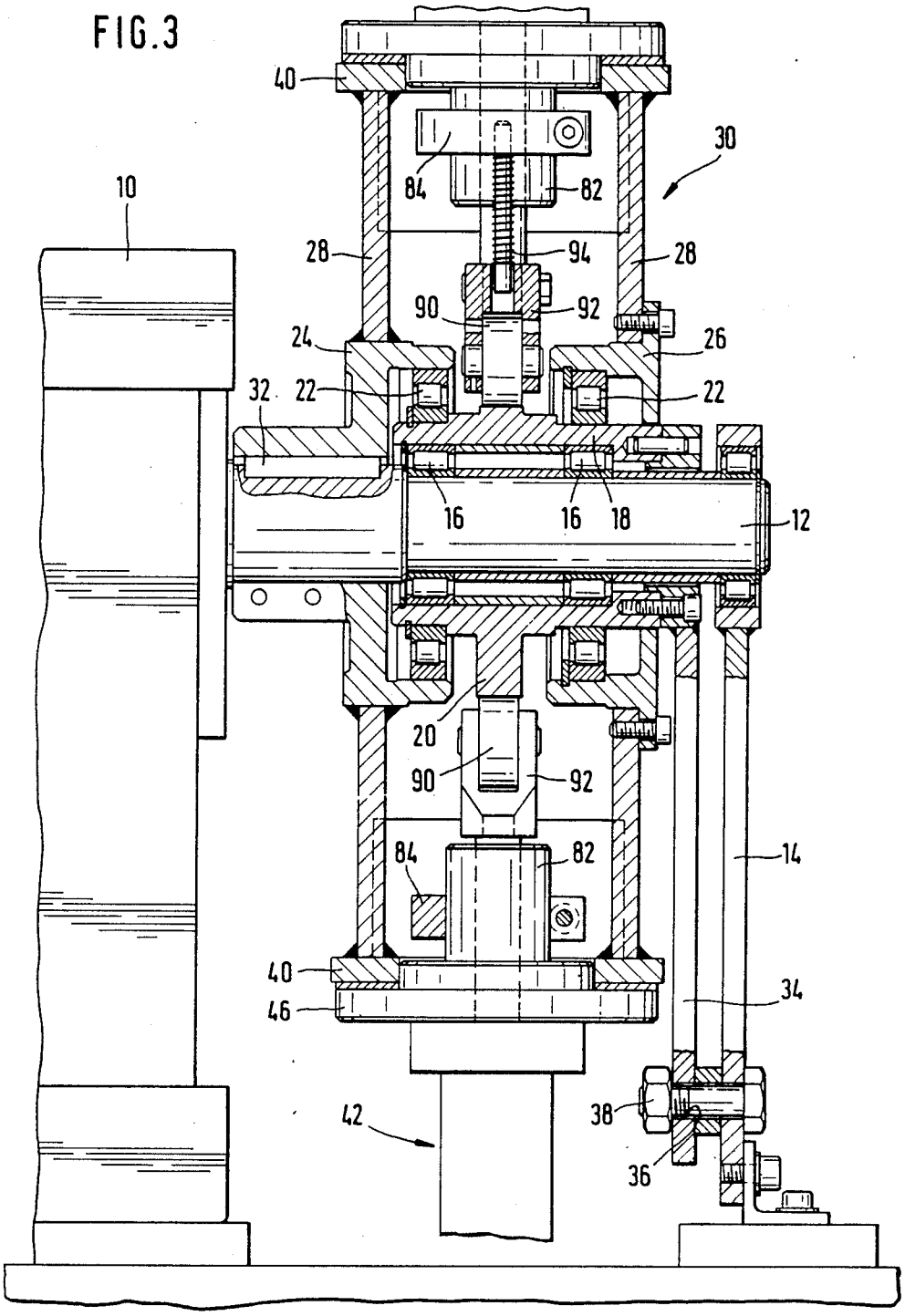
Figure 4:
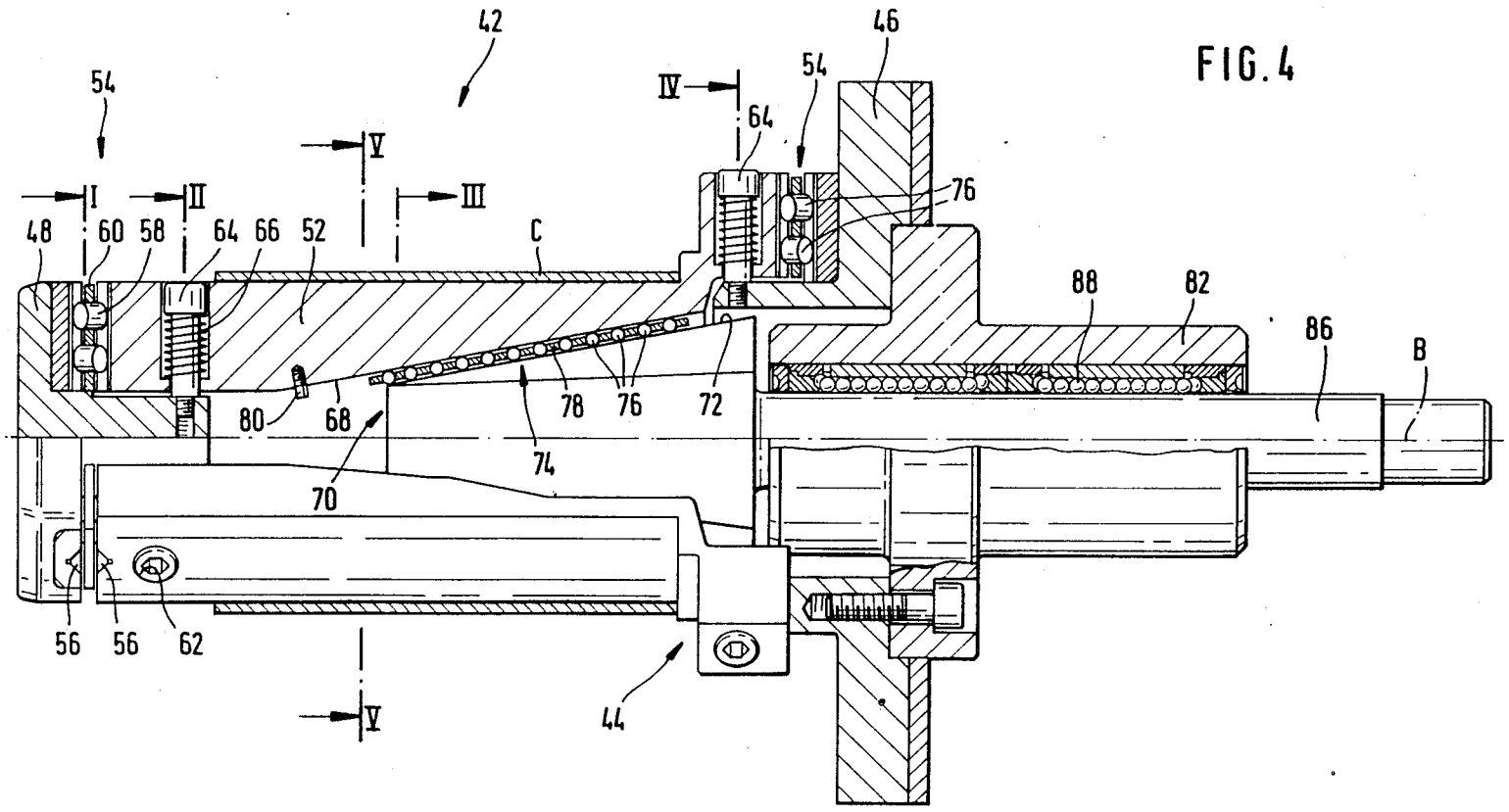
Figure 5:
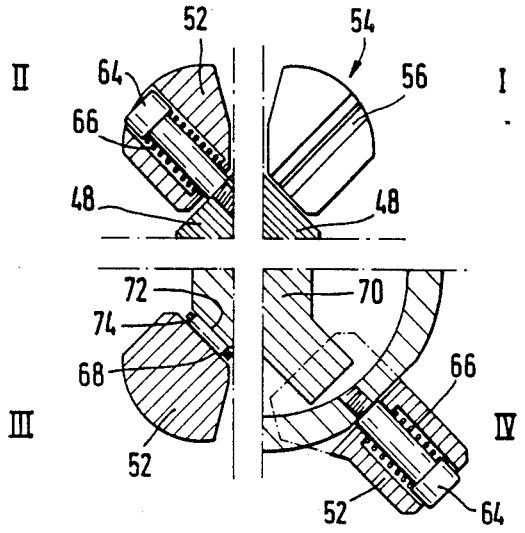
Figure 6:
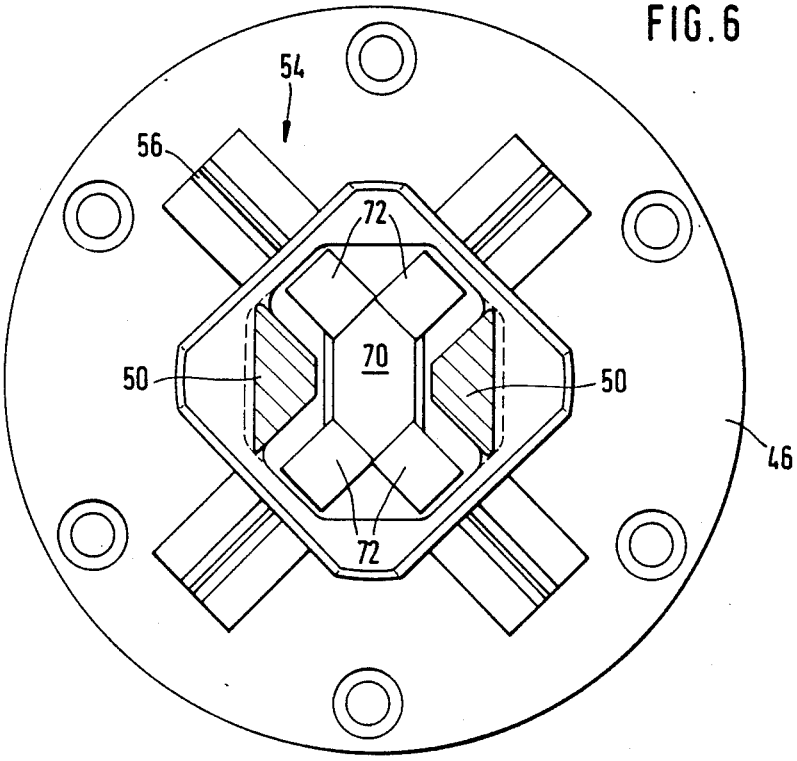
Figure 7:
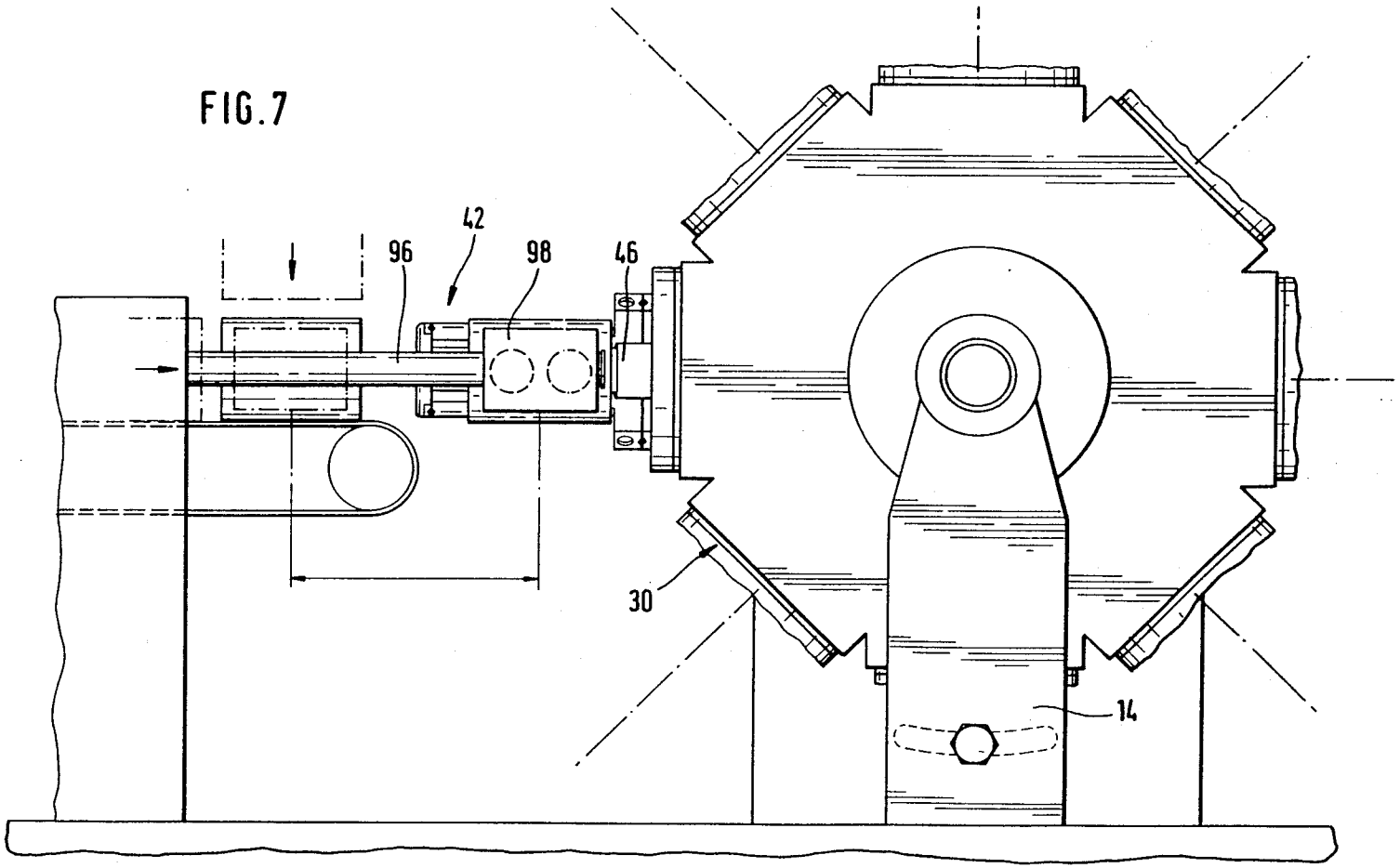

FIG. 1 shows an oblique view of an apparatus according to the invention for altering the cross-sectional shape of can bodies, FIG. 2 shows an enlarged detail from FIG. 1 with individual parts illustrated broken away, FIG. 3 shows a vertical axial section through the apparatus, FIG. 4 shows a longitudinal section through an expanding mandrel, FIG. 5 shows partial cross-sections, each of a quarter on the lines I to IV in FIG. 4, FIG. 6 shows a cross-section on the line V—V in FIG. 4, and, FIG. 7 shows a front view of the apparatus shown in FIG. 1.

The apparatus illustrated has a drive 10 which is formed, for example, from an electric motor, an infinitely variable gear and a stepping mechanism and which drives a shaft 12. In the example illustrated, the shaft 12 is horizontal and is mounted, in a manner not illustrated, in the drive 10 as well as additionally, at its free end, in a bearing pedestal 14.

According to FIGS. 2 and 3, a cam member 18, on which a radial cam 20 is formed, is mounted on the shaft 12 by means of a pair of rolling bearings 16. Mounted on the cam member 18, one at each side of the radial cam 20, by means of a further rolling bearing 22 in each case, are bearing housings 24 and 26 respectively. The bearing housing 24, which is adjacent to the drive 10, is welded to a face wall of 28 of a turret 30 and is connected to the shaft 12, for joint rotation, by means of a fitting piece 32. The other bearing housing 26 is screwed to a second face wall 28 of the turret 30. Thus the turret 30 is rotatable jointly with the shaft 12 about a central axis A defined by the latter.

Secured to an annular front face of the cam member 18, remote from the drive 10, is an adjusting device 34 in the form of a lever which is radial in relation to the central axis A. This lever has, at its end remote from the shaft 12, an arcuate slot 36 which is concentric with the shaft 12 and through which there extends a bolt 38 which is secured to the pedestal 14. By tightening the bolt 38, the cam member 18 is fixed in an angular position which can be selected in a range determined by the length of the slot 36. For example, the cam member 18 may be adjusted so that the largest radius of the radial cam 20 faces vertically upwards as shown in FIG. 2.

Normally, however, the adjusting device 34 is coupled to a drive, not illustrated here, which moves the adjusting device 34 cyclically backwards and forwards.

The turret 30 has the shape of a polygon with, in the example illustrated, eight plane frames 40 which extend parallel to the central axis A and at right-angles to the face walls 28 and are welded to the latter. Each of the frames 40 carries an expanding mandrel 42 with an expanding-mandrel axis B intersecting the central axis A at right-angles. As shown in FIG. 1, a cylindrical can body C can be placed on each of the expanding mandrels 42, the cross-section of which body is originally circular and is to be shaped into an oval or polygon in the course of a rotation of the turret 30 through 270 degrees in the example illustrated.

Each of the total of eight expanding mandrels 42 has a multiple-part supporting member 44 with a foot portion 46 which is screwed to the associated frame 40, a head portion 48 and a pair of prismatic supports 50 which connect the head portion 48 rigidly to the foot portion 46 and leave gaps free between them in which two pairs of segmental bars 52 are disposed. The supports 50 and segmental bars 52 extend parallel to the expanding-mandrel axis B.

Each of the segmental bars 52 is guided on the foot portion 46 and on the head portion 48 by a rolling-body guide 54 which is radial in relation to the expanding-mandrel axis B, in such a manner that the total of four segmental bars can be spread apart radially. Each of the rolling-body guides 54 consists essentially of a pair of radial grooves 56 of which one is formed in the foot portion 46 or head portion 48 and the other at the adjacent end of the segmental bar 52 in question, and of two cylindrical rolling bodies 58, with a cage plate 60 holding these bodies. The radial grooves 56 are prism-shaped with two flanks which are arranged at right-angles to one another and on each of which one of the two associated rolling bodies 58 can roll.

Each of the segmental bars 52 has, in the vicinity of each of its two ends, a radial stepped hole 62 which receives a screw 64, secured to the foot portion 46 or head portion 48 respectively, and a compression spring 66. The compression spring 66 is gripped between the head of the screw 64 and the step formed in the associated stepped hole, in such a manner that it tends to displace the segmental bar 52 radially inwards towards the expanding-mandrel axis B. On the side of each segmental bar 52 which is radially inwards in relation to the expanding-mandrel axis B, an inclined surface 68 is formed in such a manner that it converges towards the corresponding inclined surface 68 of the opposite segmental bar 52 in the direction towards the free end of the expanding mandrel 42 in question.

For spreading the segmental bars 52 apart, each expanding mandrel 42 includes a wedge 70 which has inclined surfaces 72 parallel to the inclined surfaces 68. Disposed between each of the associated inclined surfaces 68 and 72 is a rolling-body guide 74 which is formed from cylindrical rolling bodies 76 and a ladder-like cage plate 78. The movement of each cage plate 78 in the direction towards the free end of the associated expanding mandrel 42 is limited by a stop 80 which, in the example illustrated, is formed from a stud bolt screwed into the associated inclined surface 68.

Secured in each foot portion 46 is a guide tube 82 on which a flange 84 is clamped for adjustment in the direction of the expanding-member axis B. Each wedge 70 has a cylindrical shank 86 which extends through the associated guide tube 82 and is guided in this by ball guides 88. At that end of the shank 86 which is radially inwards in relation to the central axis A, a roller 90 is mounted by means of a fork-shaped roller holder 92 in such a manner that the axis of the roller 90 extends parallel to the central axis A. Gripped between the roller holder 92 and the flange 84 is a pair of springs 94 which tend to hold the roller holder 92 and hence also the wedge 70 rigidly connected thereto, in a radially inner position in which the wedge 70 allows the associated segmental bars 52 to assume a radially inner position in relation to the expanding-mandrel axis B, under the action of the compression springs 66. The springs 94 ensure that the associated roller 90 rolls uninterruptedly on the radial cam 20.

During each revolution of the turret 30, each of the expanding mandrels 42 passes through a position in which its expandingmandrel axis B is in alightment with a horizontal feed axis D. One circular cylindrical can body C at a time is pushed along this feed axis D onto the expanding mandrel 42 in question. For this purpose, a pair of bars 96 is stationarily mounted, parallel to the feed axis D, between which bars the expanding mandrels 42 can be moved through and on each of which an entrainment member 98 is displaceable to convey one can body C at a time. The entrainment members 98 are equipped, for example, with magnets, suction cups or the like so that they grip one can body C at a time, at a transfer point not illustrated, and entrain it to the particular expanding mandrel 42 which is standing between the two bars 96.

The can body C is pushed onto an expanding mandrel 42 while the turret 30 stops briefly. At the same time, the setting device 34 is turned slightly by the drive not illustrated, in sequence with the movement of the entrainment members 98. As a result, the can body C is clamped by the expanding mandrel 42 and the entrainment members 98' can be withdrawn without any problems and without pushing the can body C back again.

Each can body C slipped onto one of the expanding mandrels 42 in this way is gradually deformed during the further rotation of the turret 30, by the segmental bars 52 being spread apart. Subsequently, the segmental bars 52 return to their position of rest so that the deformed can body C can be withdrawn from the expanding mandrel 42. In the example illustrated, this is the case after the turret 30 has turned through 270 degrees; the deformed can bodies are withdrawn vertically downwards.

I claim:

1. An apparatus for altering the cross-sectional shape of can bodies, said apparatus comprising:

a turret which can be driven in rotation about a central axis;

a plurality of expanding mandrels, each of which has an expanding-mandrel axis, said plurality of expanding mandrels being arranged on the turret and around the central axis with each expanding-mandrel axis being generally perpendicular to the central axis, each expanding mandrel including an associated supporting member secured to the turret and extending along the expanding-mandrel axis, a plurality of associated segmental bars arranged around the expanding-mandrel axis and guided on the supporting member for radial adjustment relative to said expandingmandrel axis, each of said plurality of expanding mandrels also including an associated wedge, wherein said segmental bars may be spread apart by displacing said wedge along said expanding-mandrel axis and, a common actuating member for displacing said wedges in sequence during one revolution of the turret, said actuating member being a central radial cam member on which each of the wedges is supported at least during a portion of each revolution of the turret, wherein said radial cam member can displace each wedge along said expanding-mandrel axis and thereby spread said segmental bars apart.

2. An apparatus according to claim 1 having a central shaft which connects the turret to a drive characterized in that the radial cam member is mounted on the shaft and can be set in a selected angular position by adjusting means.

3. An apparatus according to claim 1 characterized in that each wedge further includes a shank, each shank being guided in the associated supporting member and having at one end of the shank a roller which rolls on the cam member.

4. An apparatus according to claim 3, characterized in that each wedge is biased toward said radial cam member by at least one spring.

5. An apparatus according to claim 4, characterized in that the rollers are held in continuous contact with the cam member by the biasing force exerted by said springs.

6. An apparatus according to claim 1 characterized in that each of said supporting members includes a head portion and a foot portion and the segmental bars are guided for radial adjustment between the foot portion and the head portion of the associated supporting member.

7. An apparatus according to claim 1 characterized in that each of the segmental bars cooperates with the associated wedge through a rolling-body guide.

* * * * *